US006447409B1

(12) United States Patent
Squibb

(10) Patent No.: US 6,447,409 B1
(45) Date of Patent: Sep. 10, 2002

(54) BREAKAWAY BASKETBALL RIM ASSEMBLY

(75) Inventor: Neal C. Squibb, Scranton, IA (US)

(73) Assignee: American Sports International, Ltd., Jefferson, IA (US)

( * ) Notice: Subject to any disclaimer, the term of this patent is extended or adjusted under 35 U.S.C. 154(b) by 0 days.

(21) Appl. No.: 09/850,970

(22) Filed: May 8, 2001

(51) Int. Cl.[7] ..... A63B 63/08
(52) U.S. Cl. ..... 473/486
(58) Field of Search ..... 473/486, 472, 473/485, 487, 489

(56) References Cited

U.S. PATENT DOCUMENTS 5,716,294 A 2/1998 Childers et al.

6,080,071 A 6/2000 Childers

*Primary Examiner*—Paul T. Sewell
*Assistant Examiner*—M. Chambers

(57) ABSTRACT

A breakaway basketball rim assembly with a mounting unit with a vertical baseplate and a horizontal mounting plate, and a rim unit having a circular hoop portion and a pivot plate that projects rearwardly from the hoop portion in spaced relation above the mounting plate. A ball bearing is positioned between the pivot plate and the mounting plate to provide the pivot point for releasing the rim unit when a downward load is placed upon the hoop portion. At least one stop is placed on top of the mounting plate to restrict the movement of the pivot plate and load a plurality of spring-loaded attachments that extend from the pivot plate through the mounting plate to return the rim unit to a generally horizontal position.

5 Claims, 4 Drawing Sheets

BREAKAWAY BASKETBALL RIM ASSEMBLY

BACKGROUND OF THE INVENTION

The present invention relates to basketball rim assemblies and in particular to assemblies designed to alleviate excessive loads applied to the rim.

One of the problem areas in modern day basketball is the abuse to which a basketball rim and backboard may be subjected when a player executes a "dunk" shot. In some instances, when the player has completed the dunk shot and is falling toward the ground, the player will grab the rim to retain his balance or possibly break the fall. Also, it sometimes happens that the player will subject the rim to impact loads in the execution in the dunk shot by slamming his arms downwardly against the rim as he is thrusting the ball through the hoop.

Unless otherwise alleviated, the forces exerted on the rim by the various executions of the dunk shot can cause the rim to deform, or more seriously, cause the glass backboard to shatter. In either case, the problems are both expensive to correct and causes unacceptable delay of the game. For this reason, various release devices have been adopted in recent years which permit the rim to "break away" from the backboard, rather than receiving the full brunt of the impact forces. Typically, these systems have taken the approach of mounting the rim to the backboard by means of a spring mount that urges the rim towards its horizontal plane position. When a downward force is exerted on the rim sufficient to overcome the forces of the spring, the spring deflects downwardly. Then, when the downward force is released (e.g., by the player releasing the rim from his grip), the spring returns the rim to its plane position. The mechanism may also be provided with means for dampening the return motion.

A number of "breakaway" rims which employ this basic principle are known in the prior art. Examples include those shown in the following U.S. Pat. No. 4,111,420 (Tyner '420); U.S. Pat. No. 4,194,734 (Tyner '734); U.S. Pat. No. 4,365,802 (Ehrat); U.S. Pat. No. 4,433,839 (Simonseth); U.S. Pat. No. 4,534,556 (Estlund et al.); U.S. Pat. No. 5,716,294 (Childers et al.); U.S. Pat. No. 6,080,071 (Childers et al.). Although these various designs differ in some aspects, they all include complicated designs requiring heavily machined parts, they fail to increase and equalize the strength of the side portions of the rim with the front portion of the rim, and they are limited in the rate that the spring load is activated to return the rim to a generally horizontal position after a downward force is released from the rim.

Therefore, an objective of the present invention is to provide a rim assembly that strengthens the sides of the rim in relation to the front.

A further objective is to provide a rim assembly that increases the rate at which a rim returns to a generally horizontal position after the rim has been subjected to a downward force.

A still further objective of the invention is to provide a rim assembly with a simple design requiring a minimum of heavily machined parts.

BRIEF SUMMARY OF THE INVENTION

The present invention includes three general parts. First, the invention has a mounting unit having a vertical baseplate for mounting to a backboard and a perpendicular mounting plate that extends from the baseplate. Second, the invention has a rim unit with a circular hoop portion and pivot plate that projects rearwardly from the hoop portion toward the backboard in spaced relation above the mounting plate. Third, the invention has a pivot-spring mechanism that allows the rim unit to release when downward force is applied to the hoop portion and return to a generally horizontal position when the force is released. A ball bearing is placed between the pivot plate and the mounting plate and creates a pivot point upon which the pivot plate moves when the rim is confronted with a downward force. At least one stop is positioned on top of the mounting plate extending upwardly toward the pivot plate. The stops restrict the movement of the pivot plate. Finally, a plurality of spring-loaded attachments extend from the pivot plate through the mounting plate. When a load is received on the hoop portion of the rim the pivot plate rotates about the ball bearing in the direction that the load is received. The spring-loaded attachments resist this movement along with the stops. When the load is released the spring-loaded attachments return the rim to a generally horizontal position. The stops accelerate the rate at which the spring-loaded attachments act upon the rim.

DETAILED DESCRIPTION OF THE INVENTION

Figure 1:
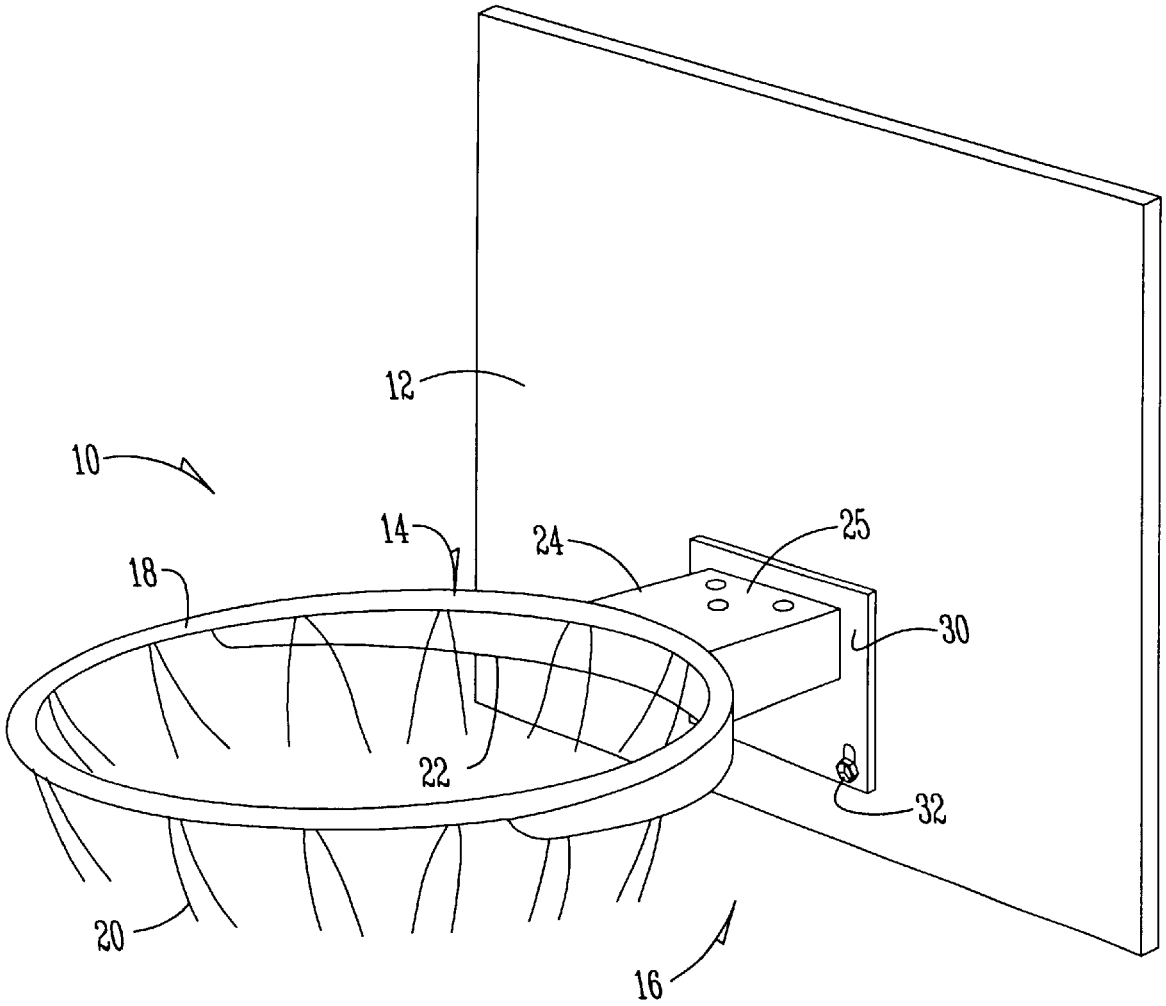
FIG. 1 is a perspective view of the breakaway basketball rim of the present invention.

FIG. 1 provides a perspective view of the breakaway basketball rim assembly 10 in accordance with the present invention, mounted to a backboard 12. As can be seen, the rim assembly 10 comprises two major subassemblies, namely the substantially horizontally extending rim unit 14 and the mounting unit 16.

The rim unit comprises a circular, regulation-size hoop member 18 which supports the net 20. Along its sides and towards its rearward end, the hoop member 18 is provided with a downwardly extending stiffening flange 22, and a horizontally extending pivot plate 24 projects from the rearward edge of the hoop member 18 perpendicularly toward the backboard 12. The pivot plate 24 has an upper and lower surface 25, 26 with a chamfered hole 28 formed within the lower surface 26 of the pivot plate 24.

Figure 2:
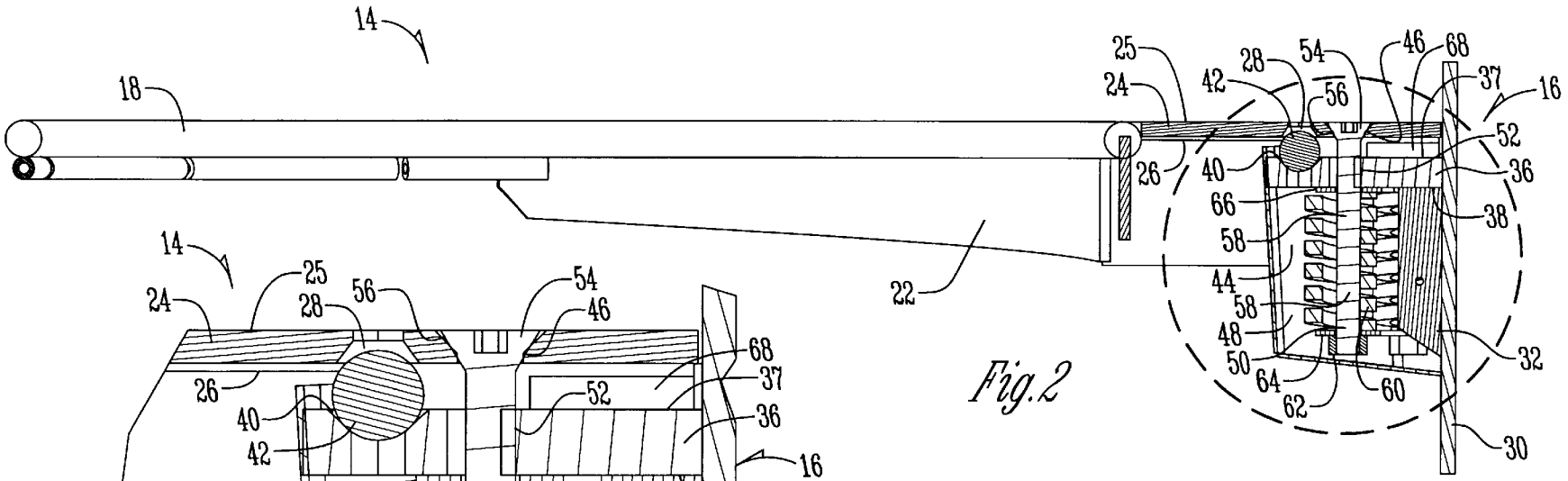
FIG. 2 is a side view of the breakaway basketball rim of the present invention.

The mounting unit 16 comprises a baseplate 30 which is mounted to the backboard 12 by corner bolts 32. A pair of vertically and outwardly extending bracket plates 34*a*, 34*b* are welded to the baseplate 30, and support a horizontally extending mounting plate 36, which is not clearly visible in FIG. 1, but is shown in greater detail in FIGS. 2–3. The mounting plate 36 has an upper and lower surface 37, 38 with a chamfered hole 40 formed within the upper surface 37 of the mounting plate 36. Preferred is mounting plate 36 formed in a triangular shape.

The mounting unit 16 represents the stationary portion of the assembly 10, while the rim unit 14 is free to pivot relative thereto in response to downward impact on the hoop portion. A ball bearing 42 provides the pivot point upon which the rim unit moves in response to downward forces exerted on the hoop. As a result, no matter where a downward impact load is received along the frontal arc of the hoop 18, the ball bearing 42 provides a pivot point that allows the rim unit 14 to pivot downwardly in a plane which is directly aligned with the impact load, no matter where this develops along the frontal arc of the hoop.

Figure 3:
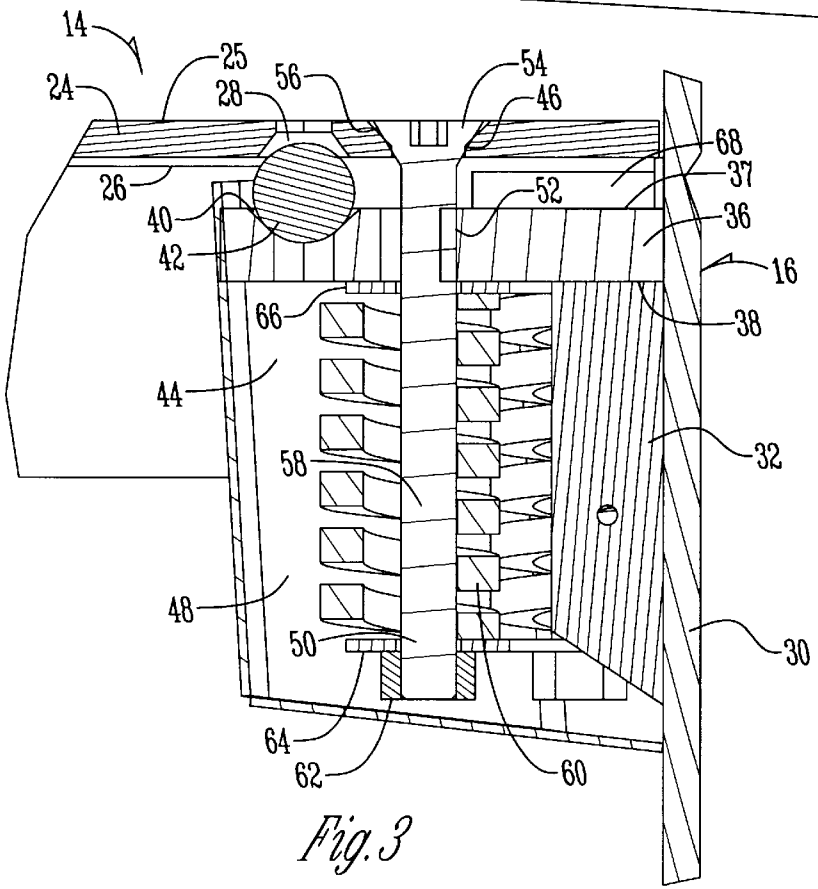
FIG. 3 is a side view of a vertical cross-section showing the pivot mechanism and return spring of the rim assembly shown in FIG. 2.
Figure 4:
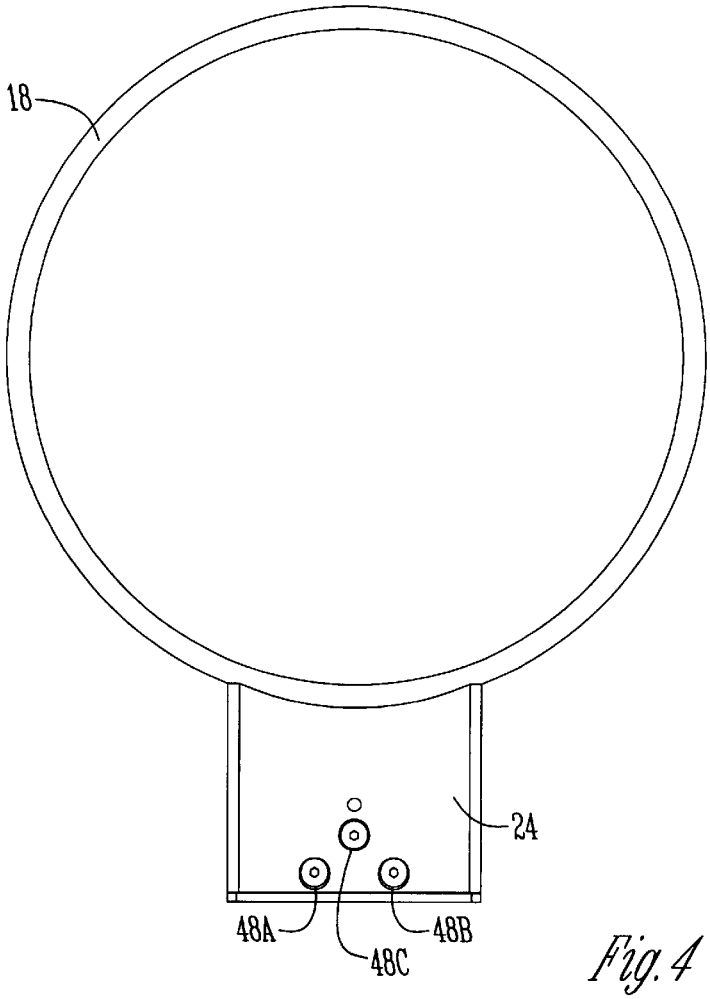
FIG. 4 is a top plan view of the breakaway basketball rim of the present invention.

FIG. 3 is an enlarged view of the mounting unit 16 and the rearward portion of the rim unit 14, showing the spring mechanism 44 in greater detail. As can be seen, the mounting plate 36 is welded to the baseplate 30 and bracket plates 34*a,* 34*b* of the mounting unit 16 which support the mounting plate 36. The mounting plate 36 is provided with a chamfered hole 40 in the upper surface 37 of the mounting plate 36 in which the ball bearing 42 is placed. The upper part of the spring mechanism 44 is formed by the pivot plate 24 having a chamfered hole 28 on the lower surface 26 of the pivot plate 24 which matches and fits with chamfered hole 40. The ball bearing 42, when placed in chamfered holes 28 and 40, is positioned between the pivot plate 24 and the mounting plate 36.

A plurality of bores 46 are formed through the pivot plate 24 to provide reaction load attachments 48. A plurality of spring-loaded bolts 50 extend through the bores 46 and through corresponding bores 52 formed in the mounting plate 36. The heads 54 of the bolts 50 are sized to be retained by the pivot plate 24 and are provided with spherically beveled lower edges 56. The shafts 58 of the bolts 50 extend downwardly below the mounting plate 36 (between the two bracket plates 34*a,* 34*b*) and are surrounded by coil springs 60. Nuts 62 are threaded onto the lower ends of the bolts 50 to compress the coiled springs 60 between a lower washer 64 and an upper washer 66 which abuts the lower surface 38 of the mounting plate 36. Thus, as the reaction load attachments 48 are pulled upwardly in response to downward impact on the hoop portion 18 of the rim 14 the spring 60 is compressed between the mounting plate 36 and the lower washer 64, offering progressively increasing resistance to the displacement of the rim. Also by adjusting the position of the nut 62 on the threaded lower end of the bolt 50, the resistance which is offered by the spring 60 can be set to a predetermined pre-load, thereby adjusting the minimum downward load which is required to displace the rim unit from its seat for desired feel and breakaway tension.

Figure 5:
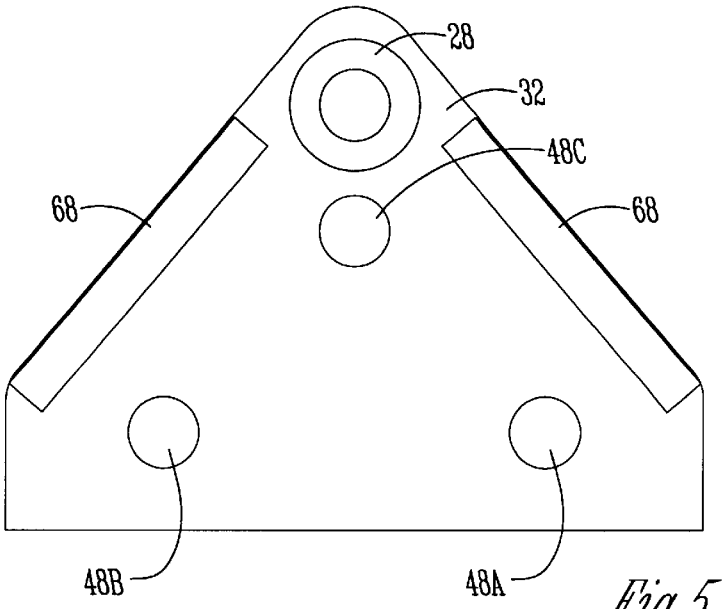
FIG. 5 is a top plan view of the mounting plate.

Preferred is the use of three reaction load attachments 48A, 48B, 48C with two load attachments 48A, 48B positioned toward the backboard and a third 48C positioned behind the ball bearing 42, as best shown in FIG. 5. In this configuration, load attachment 48C keeps the rim from coming up in the front or rising when hit from the bottom, and holds the rim unit 14 and mounting unit 16 together. Load attachments 48A and 48B provide the resistance to the displacement of the rim through its range of motion.

Figure 6:
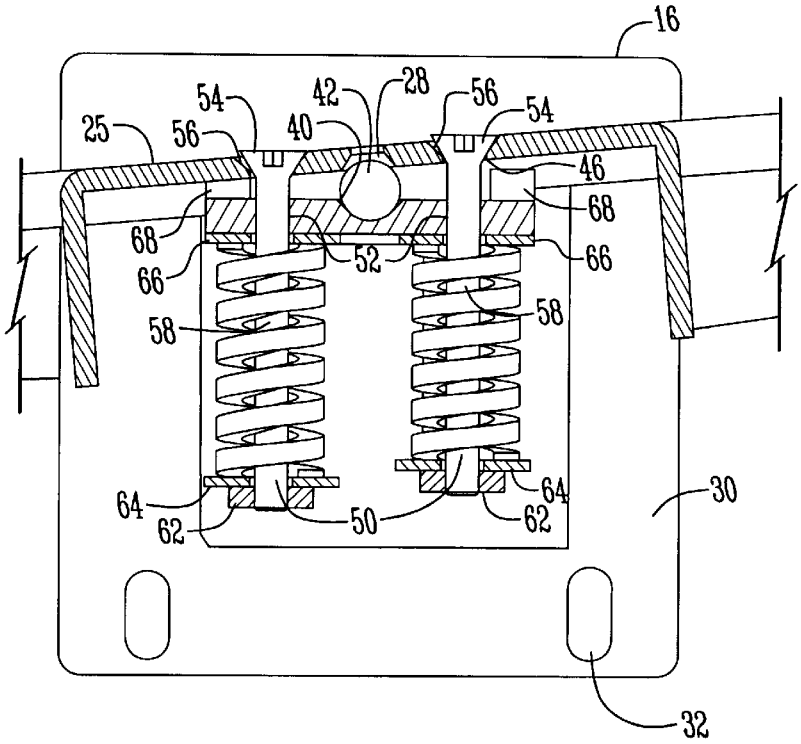
FIG. 6 is a sectional view of the basketball rim assembly with a downward load on the left of the hoop portion.
Figure 7:
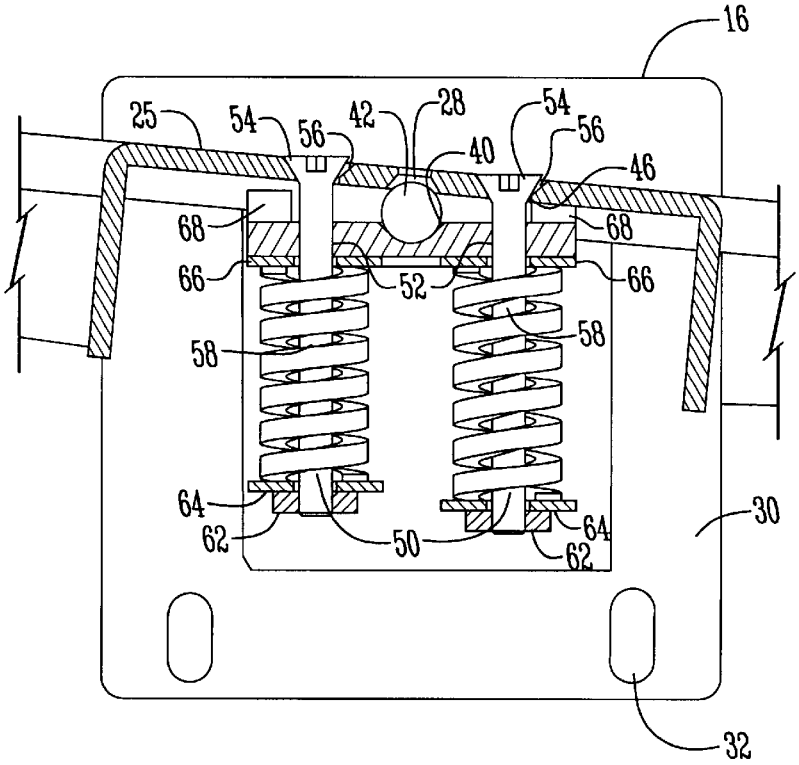
FIG. 7 is a sectional view of the basketball rim assembly with a downward load on the right of the hoop portion.

Mounted on the mounting plate 36 and extending upwardly thereon are a plurality of stops 68. Preferred are two ¼"×¼"×2" stops 68 that are positioned on the outer edge of the mounting plate 36 as best shown in FIG. 5. The stops 68 provide additional limitations in relation to the load attachments 48, and ball bearing 42, on the displacement of the rim when loaded. As the rim is loaded to the side, as shown in FIGS. 6 and 7, the pivot plate 24 comes in contact with stop 68 and accordingly loads attachment 48A, 48B or both at an accelerated rate. Thus, the stop 68 limits the amount of lateral tilt of the pivot plate 24 and causes the springs 60 to resist displacement at a faster rate. Also, the placement of load attachments 48A and 48B, working in conjunction with stops 68, strengthen the sides of the rim which are traditionally weaker than the front.

As shown by the foregoing disclosure, this invention meets the stated objectives by providing a rim assembly with few machined parts that strengthens the sides of the rim unit and increases the rate that the rim is returned to normal condition after receiving a load. Various alterations, modifications, and/or additions may be introduced into the constructions and arrangement of parts described above without departing from the spirit or ambit of the present invention as defined by the appended claims.

What is claimed is:

1. A breakaway basketball rim assembly comprising:

a mounting unit with a baseplate for mounting to a vertically extending backboard;

a mounting plate that extends in a perpendicular direction from the baseplate having an upper surface with a first chamfered hole formed therein;

a releasable rim member having a circular hoop portion which extends in a generally horizontal plane;

a pivot plate that projects from a rearward edge of the hoop portion perpendicularly toward the backboard and in spaced relation above the mounting plate, the pivot plate having a lower surface with a second chamfered hole formed therein;

a ball bearing positioned between the pivot plate and the mounting plate fitted within the first and second holes for releasing said rim member in response to a downward load received on the circular hoop portion; and means for returning the circular hoop portion of the rim member to the generally horizontal plane following the release of the downward load from the hoop portion.

2. The rim assembly of claim 1 wherein the means for returning the hoop portion comprises a plurality of spring-loaded attachments that extend from the pivot plate through the mounting plate.

3. The rim assembly of claim 2 wherein the means for returning the hoop portion comprises at least one stop mounted to the mounting plate and extending upwardly to come into contact with the pivot plate when the downward load is received on the circular hoop portion.

4. A breakaway basketball rim assembly comprising:

a mounting unit with a baseplate for mounting to a vertically extending backboard;

a mounting plate that extends in a perpendicular direction from the baseplate having an upper surface with a first chamfered hole formed therein;

a releasable rim member having a circular hoop portion which extends in a generally horizontal plane;

a pivot plate that projects from a rearward edge of the hoop portion perpendicularly toward the backboard and in spaced relation above the mounting plate, the pivot plate having a lower surface with a second chamfered hole formed therein;

a ball bearing positioned between the pivot plate and the mounting plate fitted within first and second holes for releasing said rim member in response to a downward load received on the circular hoop portion; and a plurality of spring-loaded attachments that extend from the pivot plate through the mounting plate for returning the circular hoop portion of the rim member to the generally horizontal plane following the release of the downward load from the hoop portion.

5. The rim assembly of claim 4 wherein at least one stop is mounted to the mounting plate and extending upwardly to come into contact with the pivot plate when the downward load is received on the circular hoop portion.

* * * * *